US006679418B1

(12) United States Patent
Schwartz

(10) Patent No.: US 6,679,418 B1
(45) Date of Patent: Jan. 20, 2004

(54) INTEGRAL SELF SECTIONING FILE FOLDER

(75) Inventor: David C. Schwartz, Southboro, MA (US)

(73) Assignee: Productive Environments Inc., Hopkinton, MA (US)

( * ) Notice: Subject to any disclaimer, the term of this patent is extended or adjusted under 35 U.S.C. 154(b) by 0 days.

(21) Appl. No.: 10/045,967

(22) Filed: Jan. 14, 2002

Related U.S. Application Data

(60) Provisional application No. 60/262,448, filed on Jan. 18, 2001.

(51) Int. Cl.[7] ..... B65D 27/08
(52) U.S. Cl. ..... 229/67.4; 229/72
(58) Field of Search ..... 229/67.1, 67.4, 229/72

(56) References Cited

U.S. PATENT DOCUMENTS 3,129,872 A * 4/1964 Lutwack ..... 229/72
4,520,958 A * 6/1985 Jones et al. ..... 229/72
4,852,740 A * 8/1989 Sellar et al. ..... 206/308.3
5,598,969 A * 2/1997 Ong ..... 229/67.1
5,873,513 A * 2/1999 Ong ..... 229/67.1
6,286,752 B1 * 9/2001 Heyer ..... 229/67.3

* cited by examiner

*Primary Examiner*—Jes F. Pascua

(57) ABSTRACT

This invention relates to multi-sectioned file folders, and particularly to the construction of an integrally formed self sectioning file folder having at least a sectioning panel formed between a front and a rear cover. The invention provides for the self-sectioning panel as part of a pocket panel which pocket panel may be formed as a pocket on the front or rear cover of the file folder by a series of folding and a sealing operation. The invention provides for the formation of such a self-sectioning panel of "book mark" strips for separating piles of paper, formed from a single panel sectioned and continuously folded piece of material, where the book-mark array can be formed by only two folds and a sealing operation.

5 Claims, 13 Drawing Sheets

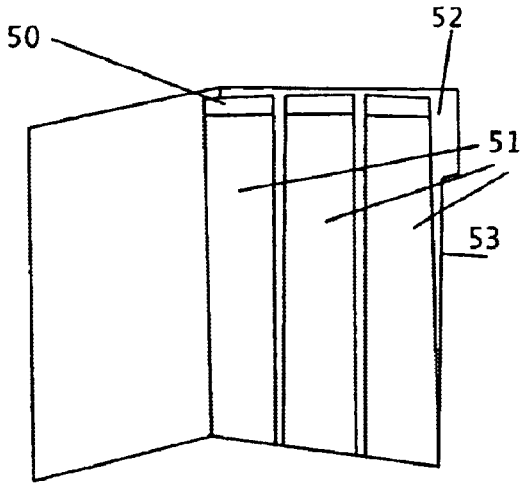
Fig.4
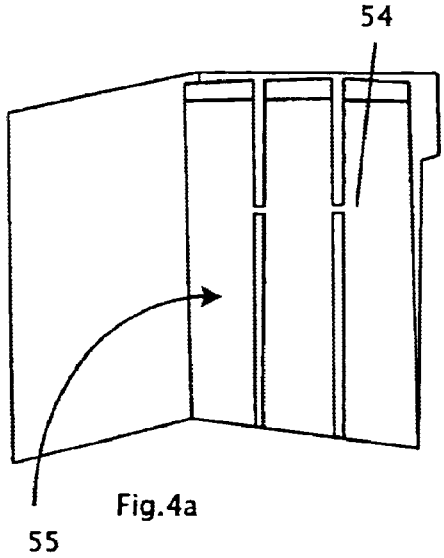
Fig.4a
Fig.5
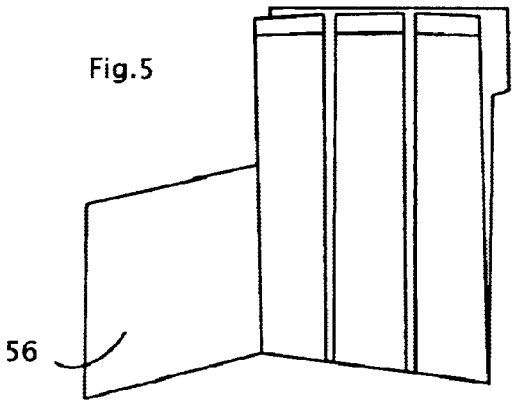

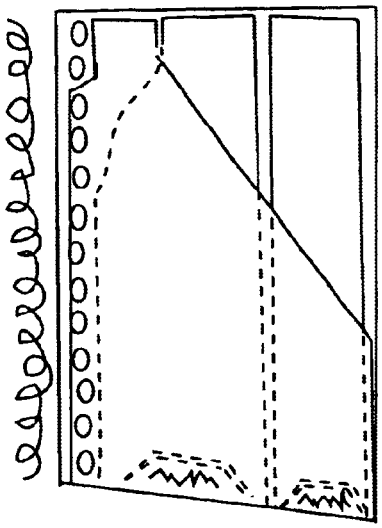
Fig.17
Fig.19
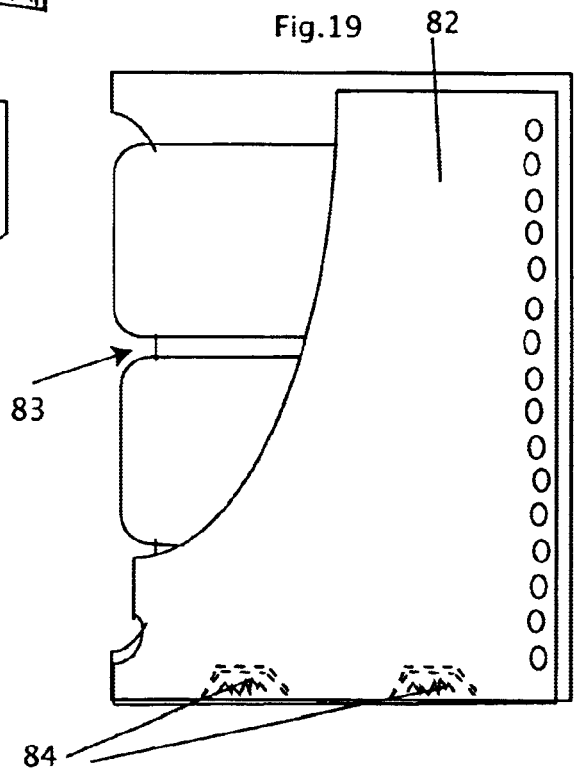
Fig.18
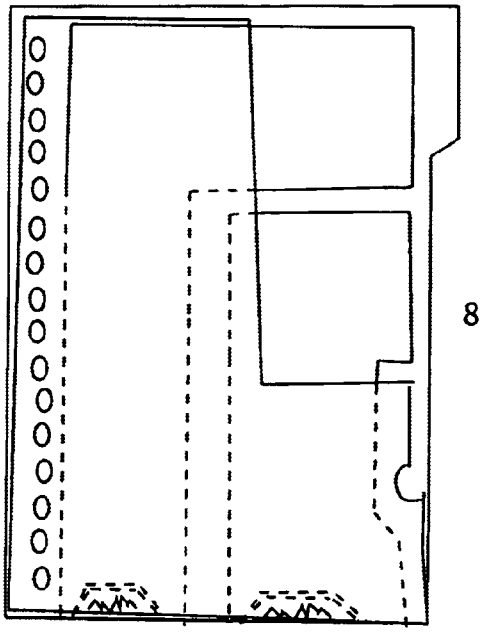

INTEGRAL SELF SECTIONING FILE FOLDER

This patent application is a filing on Provisional Patent Application No 60/262,448 filed on Jan. 18, 2001.

BACKGROUND OF THE INVENTION

This invention relates to multi-panel folders, and particularly to the construction of a multi-panel file folder enclosure which provides self-sectioning panels interior to said file folder, where said self-sectioning panel is integrally formed with the file folder panels, and may be automatically folded into a closed configuration on a high speed folding machine.

Two cover file folders have been available which are formed from a front and rear cover hinged at a spine. These file folders have a single interior area for filing materials in what amounts to substantially a pile, held between the two covers. They do not provide an integral means for sectioning out the piled materials, a requirement for a variety of record keeping applications where information is gathered and then separated within a category.

Various forms of loose section dividers are normally employed within a file folder to separate the sections, including tabbed dividers of various kinds. Usually these are full panels substantially the size of the paper held within the file. The idea of providing an integral panel, and in particular one which is separable, as by having a set of sections itself which are like a set of book marks has been unavailable heretofore. The provision of such a self-sectioning panel as part of a pocket panel which pocket panel may be formed as a pocket on the front or rear cover of the file folder has been unavailable heretofore. A self-sectioning panel of "book mark" strips for separating piles of paper, formed from a single panel sectioned and continuously folded piece of material, where the book-mark array can be formed by two folds and a sealing operation, have been unavailable.

The use of a pocket on a cover of a file folder is known. Examples include what is commonly referred to as a "stasher pocket" which is a pocket on the interior panel of the front cover of a folder or folio. In some instances, more than one pocket is so deployed although not formed in the manner provided for herein. In all instances, the inclusion of such one or more pockets is the extent of sectioning which is provided in the folder. These kinds of folders are often referred as dual pocket folders. They employ four panels, but two of the panels are utilized as pockets that are formed in combination with each of the covers of the folder. Heretofore, no four panel configuration has been provided in which solely one of the additional panels other than the front and rear cover panels is used as a pocket and the fourth panel allowed to remain free as a separator for filed papers. Heretofore, no such free separator panel has been provided as a perforated or separated set of strip marks forming an array of independently separable book marks. Heretofore, no such assembly has been provided as an integral set of panels, where a glue strip or a sealing operation can be performed to glue the pocket panel to the spine of a cover of the file folder portion to offer a single pocket, to which is hingedly attached, a free turning separator panel.

SUMMARY OF THE INVENTION

The invention therefore relates to file folders, pockets, and to separator panels for matter filed interior to the file folder, and in particular to the provision of a free turning separator panel which is integrally formed as a part of a pocket formed on one of the covers of the file folder.

The invention further relates to the construction of a file folder of the above described kind, where at least two of the sides of the pocket so formed are enclosed.

Further the invention relates to the construction of a file folder of the above described kind where a fourth panel is deployed as a panel hinged to said pocket, and where the panel is available as a free turning separator panel. Further, the invention relates to the construction of such a file folder, where the separator panel is itself sectionable into a set of book mark like subpanels which remain hinged along a common hinge axis and turn freely to separate batches of paper.

In particular, the invention relates to the construction of a file folder according to the invention, formed from one sheet of flexible material such as card stock, where the cut and fold pattern of the card stock allows for the formation of the complete file folder by a sequence of two folds and a sealing step.

The invention relates to the construction of file folders of this kind from any flexible material such as spun olefin (tyvek™/Dupont), polypropelene, vinyl, paper, plastic of other varieties or like and similar substances having from flexible to subtly rigid properties and being bondable by way of adhesive tabs, electrical bonding, heat sealing, specialty gluing, stapling and the like.

It is the further object of this invention to provide a file folder construction where the pocket base panel has a cut out section along a portion thereof to provide additional storage facilities therein.

It is a further object of this invention to integrate a box file feature into the file folder, wherein a tab is provided in the rear panel, which tab leading edge aligns with a hinged fold in the front cover to form a box file by fonding the front cover back into the tab to lock the front cover therein.

It is the object of this invention to provide for three panel constructions of a separable pocket file formed in a fashion similar to the above described file folder, incorporating a self sectioning panel, where the construction is formed from three panels, and where closure is provided along one or two edges of the front and rear cover, allowing the sectioning panel to be sandwiched there between the front and rear covers of the otherwise partially sealed folder configuration.

BRIEF DESCRIPTION OF THE DRAWINGS

The above and other objects and advantages of the invention will be apparent from consideration of the following drawings taken to conjunction with the detailed description following these drawings, in which like reference characters are used to refer to like parts and in which:

FIG. 3 Shows a front view of the integral four panel configuration used to make FIG. 1

FIG. 4 is a perspective view of a three panel configuration

FIG. 4A is a perspective view of a three panel configuration showing perfed marker panel FIG. 5 is a three panel configuration of FIG. 4 with a stub front cover

FIG. 17 is a wire version of a three panel configuration with three independent sections, where the first section is provided by the front panel FIG. 18 is a version of FIG. 17 with side tabbing FIG. 19 is a front view of the inverse version of FIG. 18

DETAILED DESCRIPTION OF THE INVENTION

Figure 1:
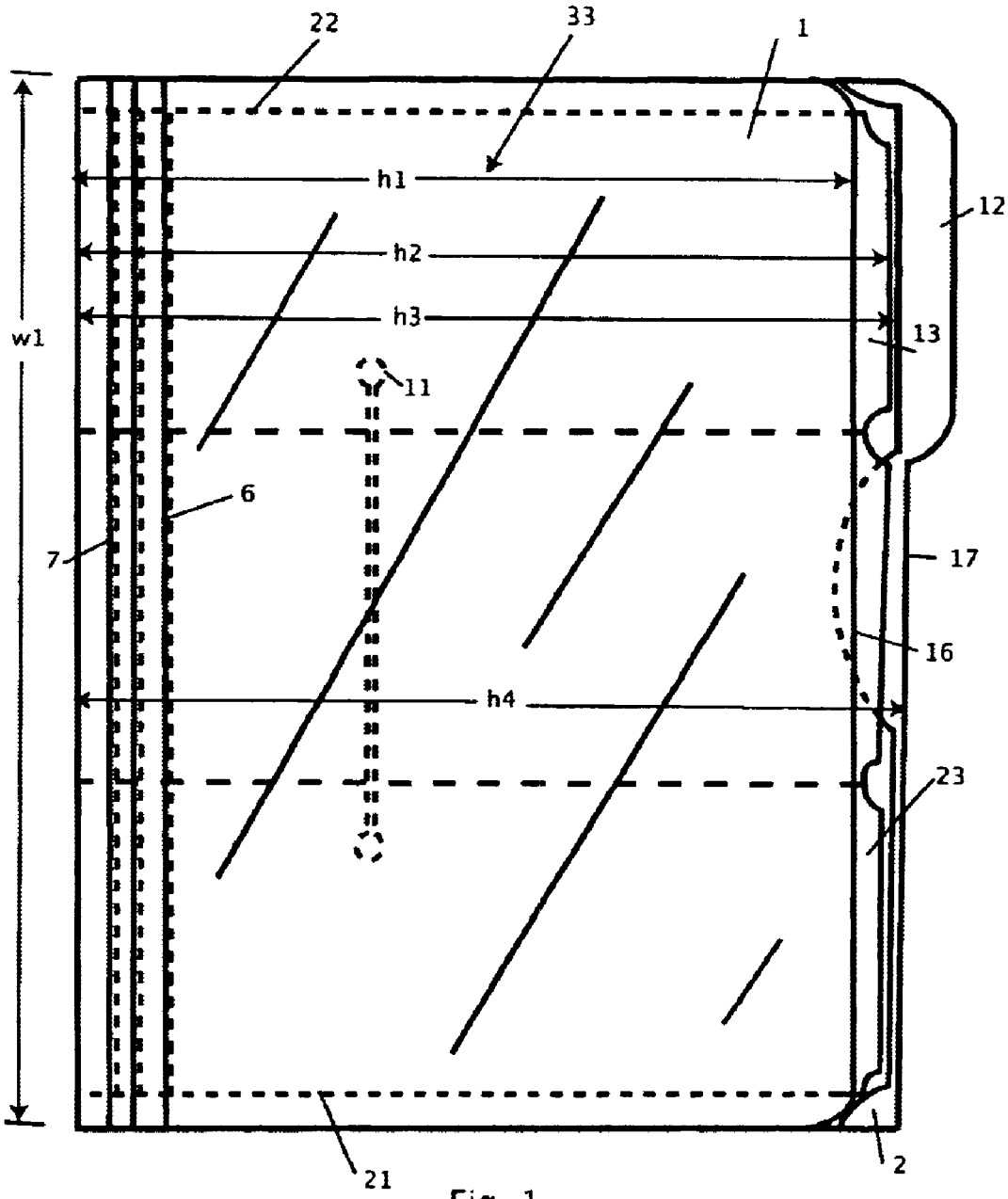
FIG. 1 Shows the front view of a four panel integral file folder in closed position FIG. 2 Shows a top perspective view of an open configuration of FIG. 1
Figure 2:
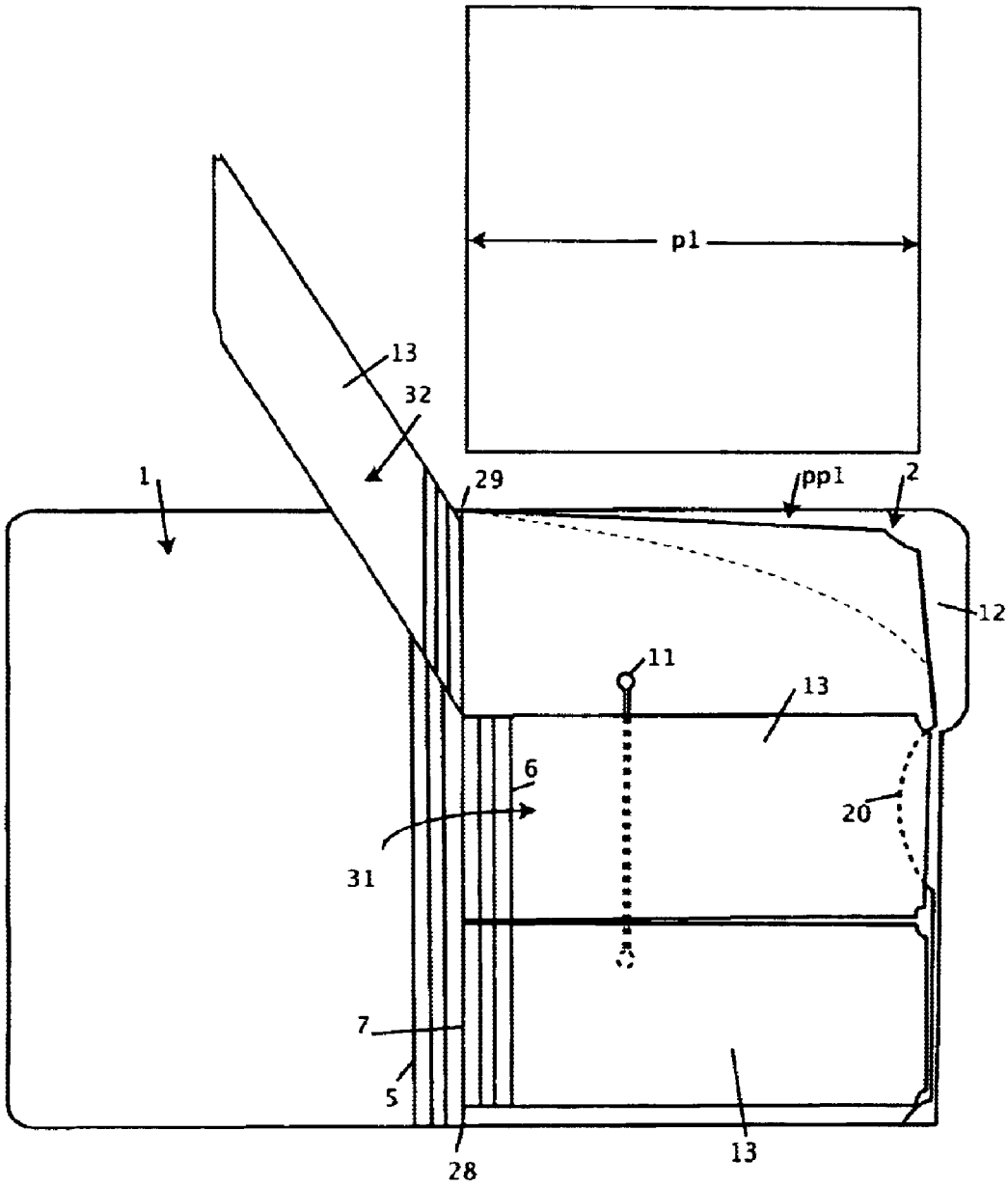

FIG. 1 shows the preferred embodiment of the integral self-sectioning file folder. In this figure the folder is shown in the closed position allowing the preferred panel heights of the four panel configuration to be seen in relation one to the other. Here it is seen that the front cover has a shortest height h1. H2 is the height of the self sectioning panel, which allows for the tab sections on the panel 13, to be seen past the edge of the front cover. H3 is the height of the rear pocket which is substantially the height of the rear, backing panel, 2, panel height. FIG. 2. Shows the file folder in an open position with one of the self sectioning panel portions, 13 shown turned out. The optional pocket slit, 11, in rear pocket 3 is shown. The self sectioning panel is hingedly attached along the spine hinge 7 between corners 28 and 29 forming pocket pp1. The height h3 of this pocket is intended to be of substantially enough extent to allow paper of height p1 to fit therein without having any overhanging edges. Each panel 13 is separable to permit the sectioning of additional papers filed therein. FIG. 3 shows the laid open four panel configuration used for folding this self sectioning pocket file. The preferred glue zone 31 is shown for the implementation in paper, where clue can be applied in line as the panel configuration is fed down the line on a high speed folding and gluing machine. The panel is laid open, glue applied in a strip or in sections along 31 zone, panels 3 and 4 are folded over sealing spine 8 along spine 7, and the folder is then "closed" by folding panels 1 and 4, which are now substantially coplanar and coterminous over hinge 7/8 onto panel 3. The sections 13, are intended to be split by perforation at the time of use by the end user. They remain perfed during the machine folding operation, so as to permit automatic folding. If this device is hand folded, the panels may be die cut in advance. It would be possible to deliver the pocket with a peelable adhesive strip, and the end user could assemble it. This configuration could be made in poly plastic and sealed along hinge 7/8 in the same area as zone 31 by heat, RF or melting operations. In the case of poly, the sections would be precut, as perfing would not tear in this kind of material. The panel can be a single section or can be die cut into two or more subsections. A three panel section is featured here. Height p1 is substantially height h1, allowing all tabs to show up across the top of the folder.

As seen in FIG. 3, the proposed preferred embodiment is formed as a section of foldable material for forming a self sectioning file folder having front, 1, and rear or backing panel 2, covers, with a pocket panel formed from portion 3, on the interior portion one of said file folder covers, particularly the backing panel 2, said section of material comprising at least an interconnected set of panels including a back panel, 2, of predetermined height, h4, having perimeter features including adjoining first and second backing panel edges, hinge 7 and hinge 15 defining said adjoining edges, a front panel, 1, a pocket panel, 3, and a sectioning panel portion, 4, which can be an integral panel or can be sectioned into sub sections, said interconnected set of panels being attached off at least one of said first and said second of said adjoining first and second backing panel edges, each of said panels having a predetermined height, h1, h2, h3 and h4 which heights are typically "width wise heights" related to the width of a sheet of paper to be filed therein , such as predetermined paper width height p1, said panels forming a front cover, 1, a rear pocket, pp1, and a sectioning panel, 4, here show comprised of sections 13, 13*a*, 13*b*, 13*c*, wherein a first panel of said first, second and third panels is disposed along a first of said first and second adjoining backing panel edges, typically said cover 1, and a third panel, here shown as the rear pocket panel 3, of said first, second and third panels is disposed along a second of said first and second adjoining backing panel edges for forming a pocket therewith, and where a second panel, here the self sectioning panel 4, of said first, second, and third panels is disposed between said first, and third panels, hingedly attached to what is the interior edge of said pocket panel, edge 8, and where each of said predetermined heights of said first, second, and third panels is preferably such that said predetermined height is substantially at least as tall as the predetermined height of a piece of paper to be held within p1, and h2 is taller than h1 by the height of the tabs thereon 23, which panel is substantially the height of the back cover h4 and the rear pocket h3, and where the tab zone of the rear pocket 12 extends above the edge 17 to allow the tab to be rear cover tab to be seen when the folder is closed.

In the preferred embodiment a gluing means is provided for attaching the hinge 8 to hinge 7 along glue zone 31 to provide a closed bottom to the pocket pp1, which additional side along edge 9 is closed by the fold hinge formed there with.

Figure 3A:
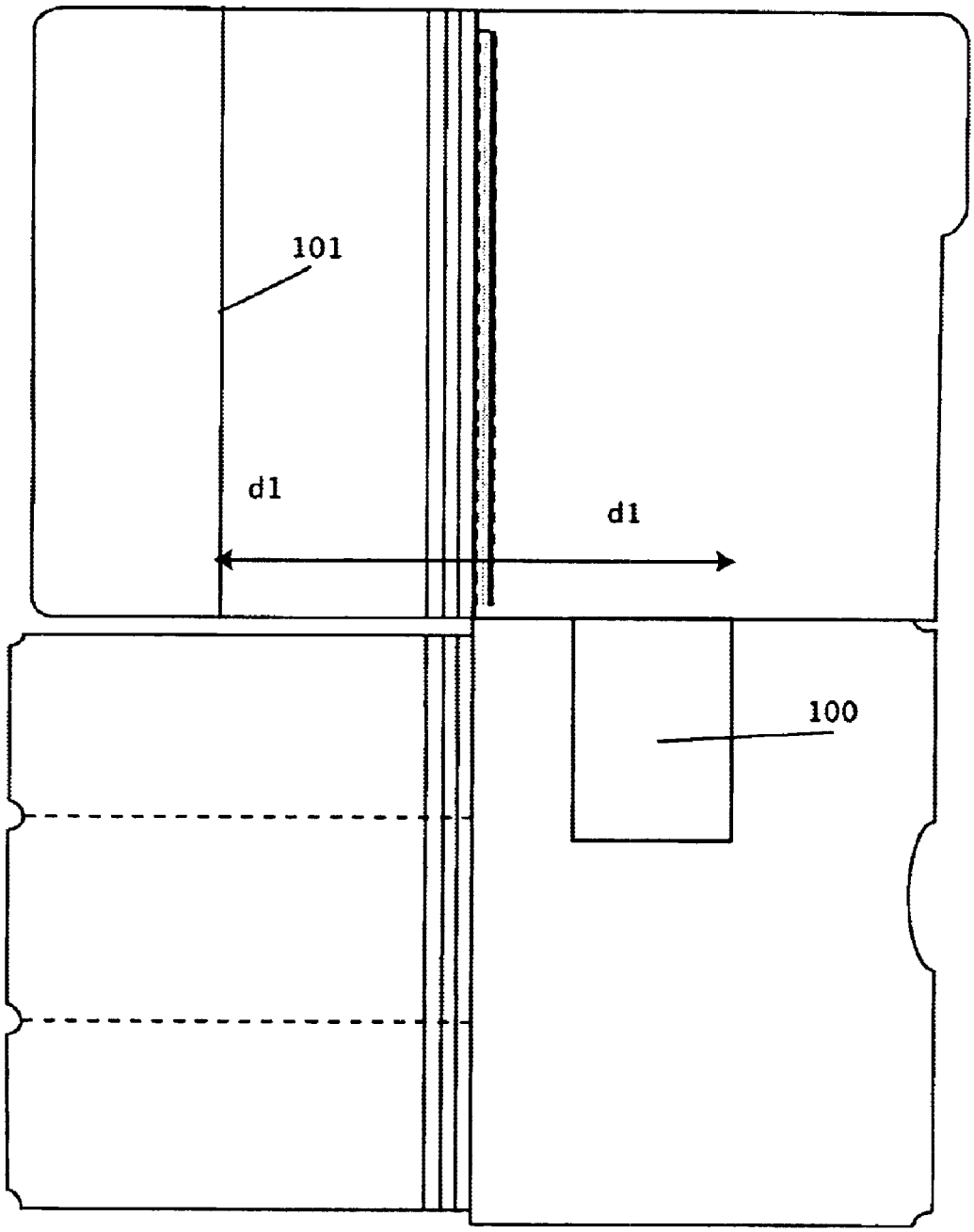
FIG. 3A shows the box file formation with the tab and cover hinge, in open panel form
Figure 3B:
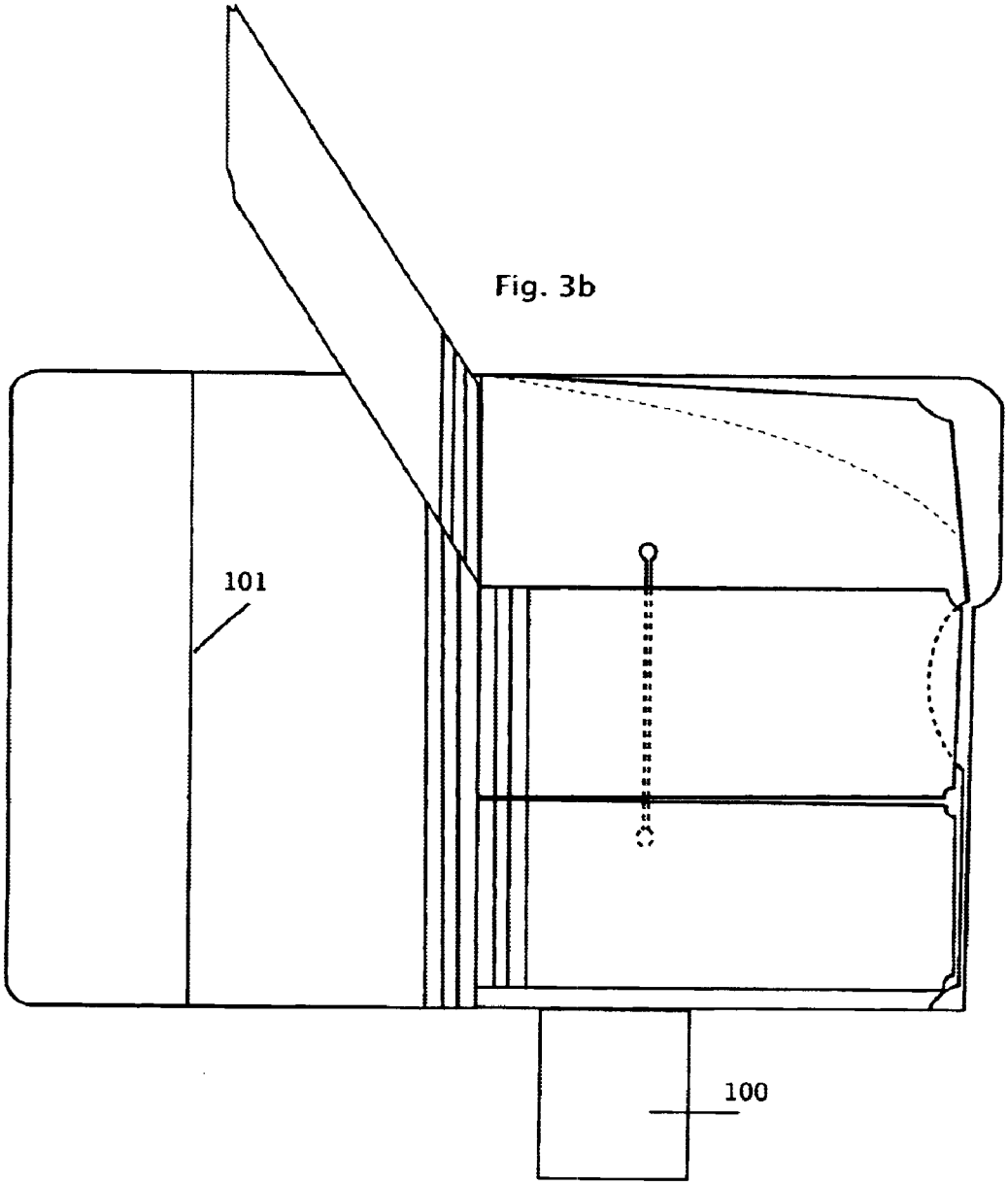
FIG. 3B shows the tab deployed
Figure 3C:
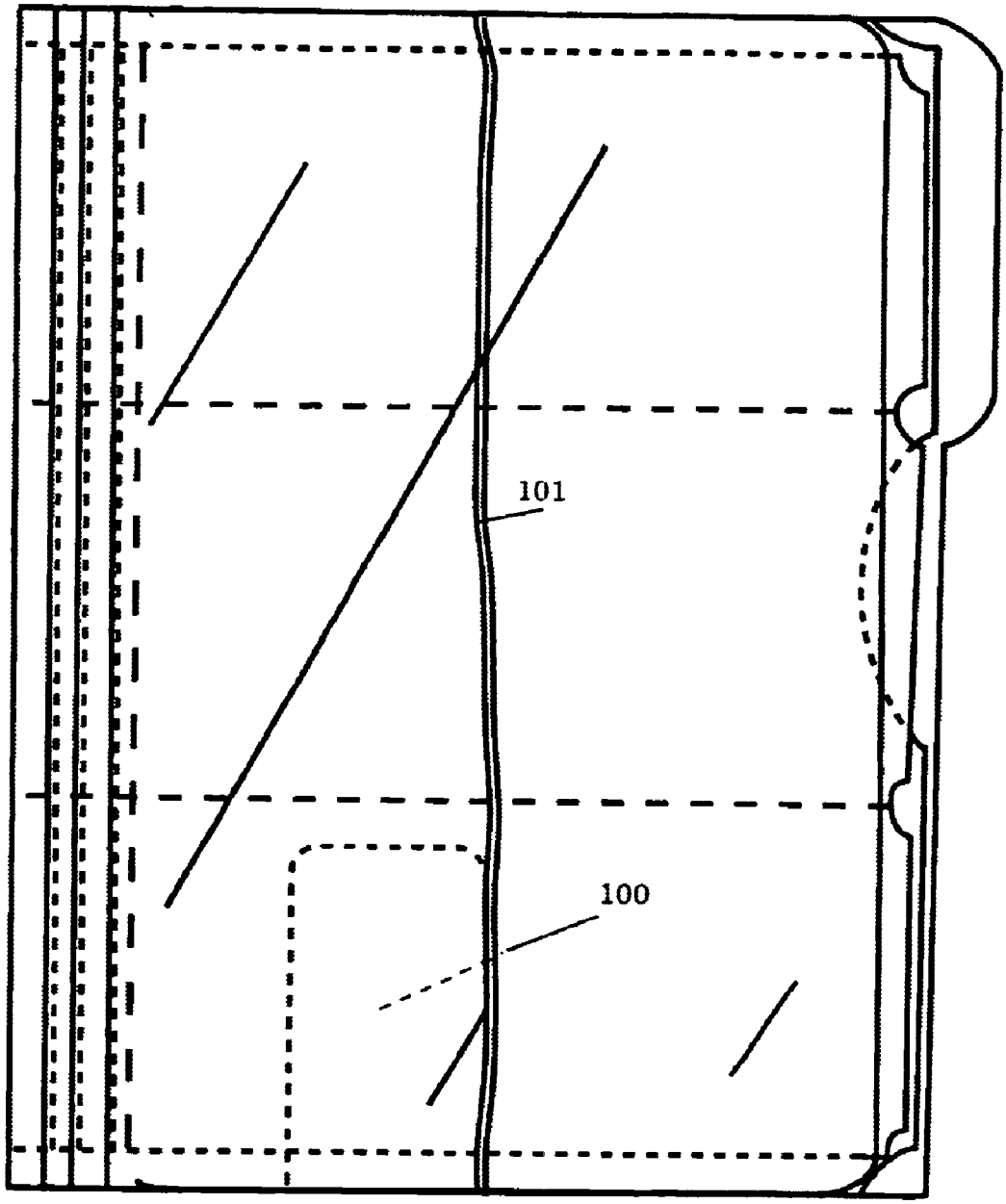
FIG. 3C shows the front cover locked behind the tab at the hinged front cover fold, exposing the sectioning panel portion.

FIGS. 3*a, b*, and *c* show the formation of a box file version of this self sectioning file folder. The cover is provided with a hinged fold, 101, at substantially the distance d1, of the leading edge of the tab 100, from the spine hinge. When the tab is popped out of the rear panel portion, it provides a locking tab behind which the hinged front cover can be folded. This allows the file to form a "box" which has closure on the spine and along the bottom. This formation is a useful way to keep the file contained without using elastics or adhesives, while preserving the full open feature of the file folder at times that the user wants to operate the file as a traditional fully open file.

Other embodiments of an integral self sectioning file folder may be constructed from three panels as shown in FIGS. 4 to 19. In this disclosure, FIGS. 4–19, details a folder having subclassification marker tabs formed as an integral unit from a single blank having substantially a series of adjacent panels, where the folder is an essentially open sided folder, and the invention details the basic most open sided format with three open sides and a series of novel closures which seal progressively 1 additional side, then 2 additional sides.

Figure 6:
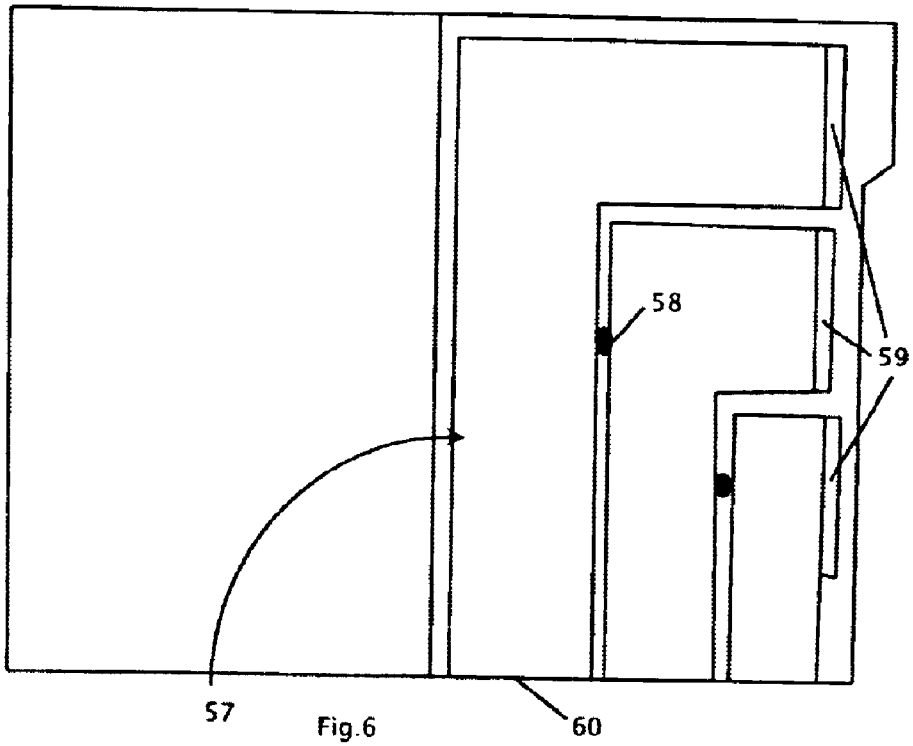
FIG. 6 is a front view of an alternative self sectioning panel providing side tabbing
Figure 7:
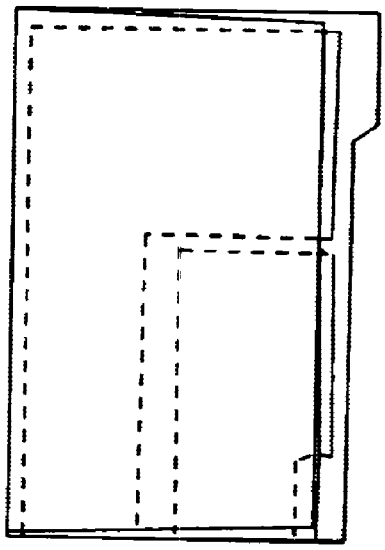
FIG. 7 shows a front view of a closed three panel file with a two section self sectioning panel

The first format provides for an integral file folder w/subclassification marker tabs having 3 open sides. This is shown in FIGS. 4–7. The landed area for perf separation makes it easy to plow over the subclassifier panel. The user can separate each tab upon use. FIGS. 6&7 show how side tabbing can be implemented.

Figure 8:
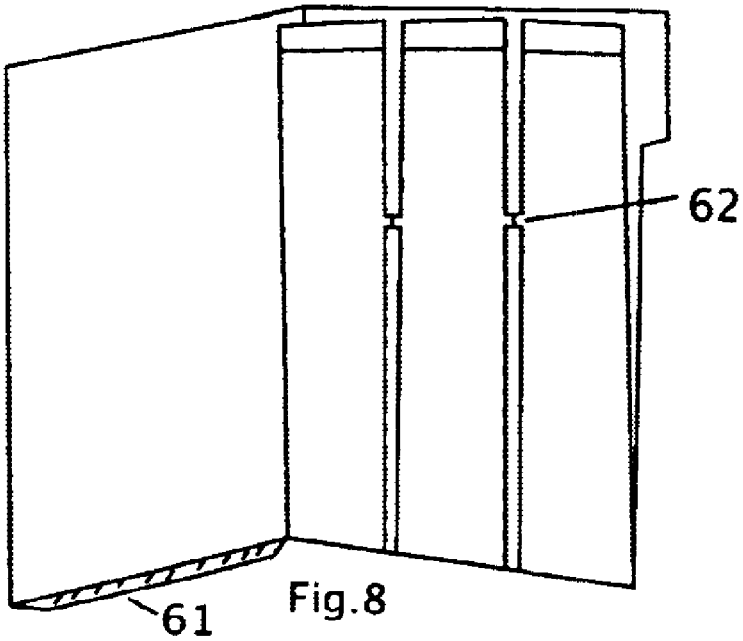
FIG. 8 is a front perspective view of a three panel file folder with a three panel self sectioning panel having a glue tab for sealing a bottom edge thereof
Figure 8A:
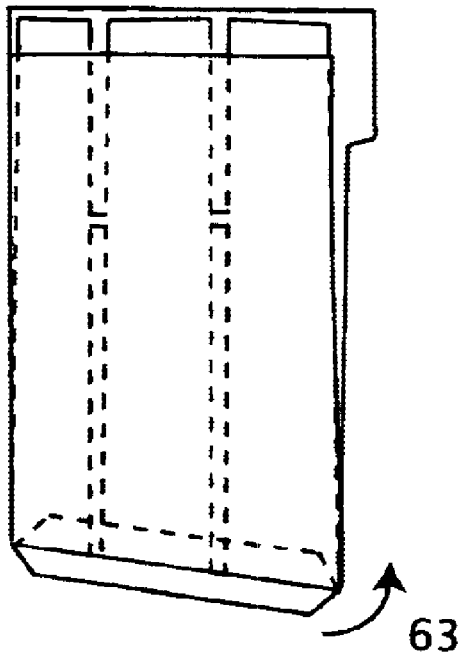
FIG. 8A shows the front view of FIG. 8 when the front panel is closed and ready for sealing
Figure 9:
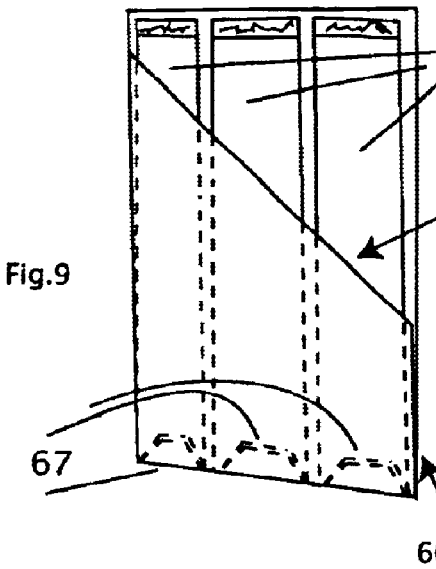
FIG. 9 shows a front three panel configuration having self sealing self sectioning panels
Figure 9B:
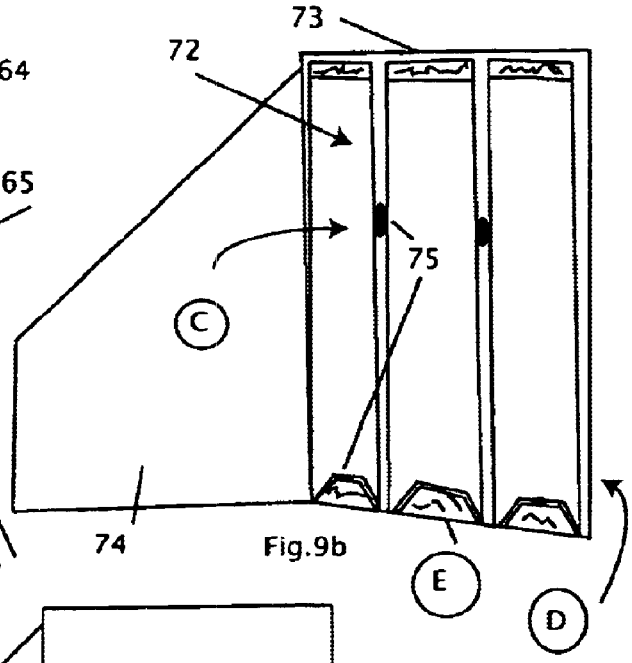
FIG. 9B shows where the glue is placed on the panel sections of FIG. 9*a*
Figure 9A:
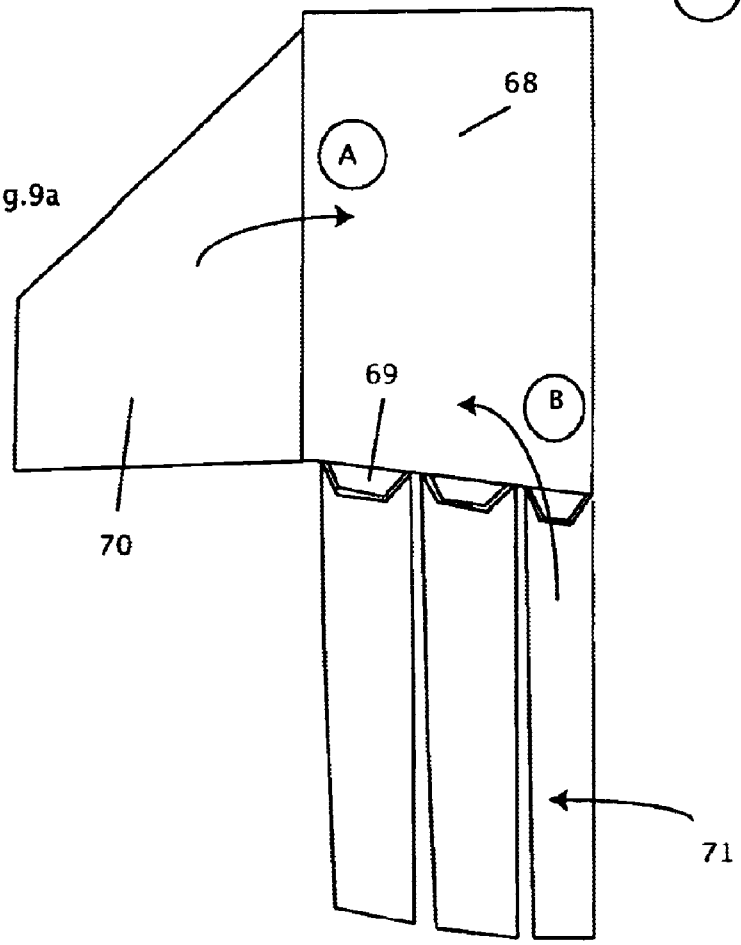
FIG. 9A shows the panel formulation of FIG. 9

To progress to a slash type format with 2 closed sides, an extra sealing flap can be utilized, FIG. 8. This shows this. Alternatively one or more sealing tabs can be hinge cut off of the bottom of the subclassification marker tab itself. When glue is applied to it, and the front flap plowed over, the same effect of 2 sided closure can be achieved. The advantage is no need to flip. It can be glued with a bump and turn operation or straight line with one flip if desired. The glue must be applied precisely to the tab. The landed areas are mini areas to keep material together for folding. They separate easily on use. If poly is used, I.e. Poly pocket, then you can heat seal onto the sealing tabs directly from the (front) cover and through by creating the bond without using glue. FIGS. 9, 9*a*, 9*b* show this.

Figure 10:
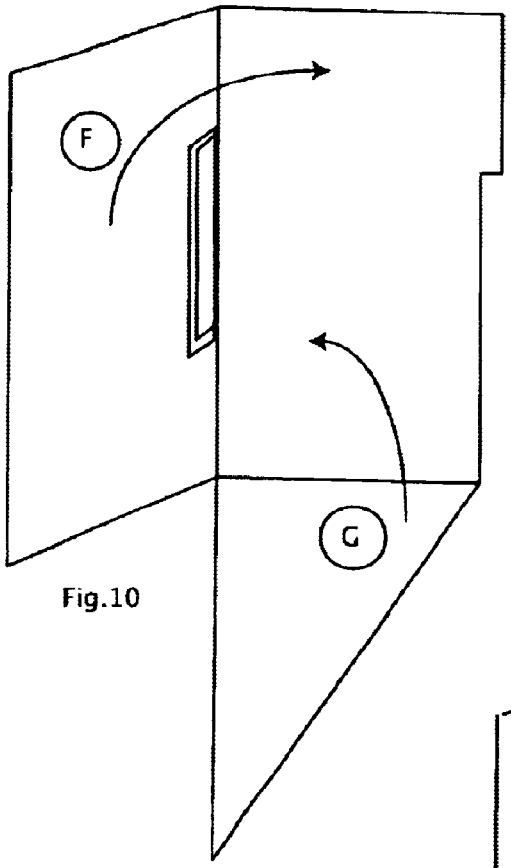
FIG. 10 is a front perspective view of a three panel folder according to this invention having a self sealing front cover
Figure 10A:
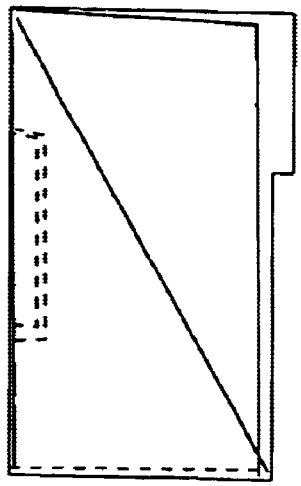
FIG. 10A shows the file of FIG. 10 closed and sealed.
Figure 11:
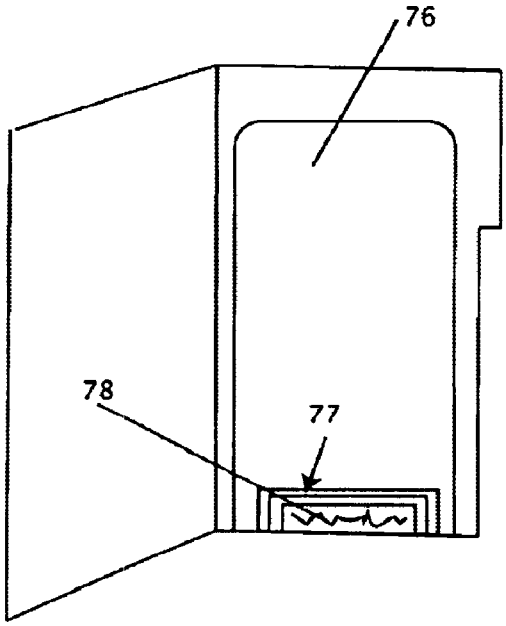
FIG. 11 shows a front perspective view of a three panel configuration with one self sectioning panel where the self sectioning panel seals across a bottom edge
Figure 12:
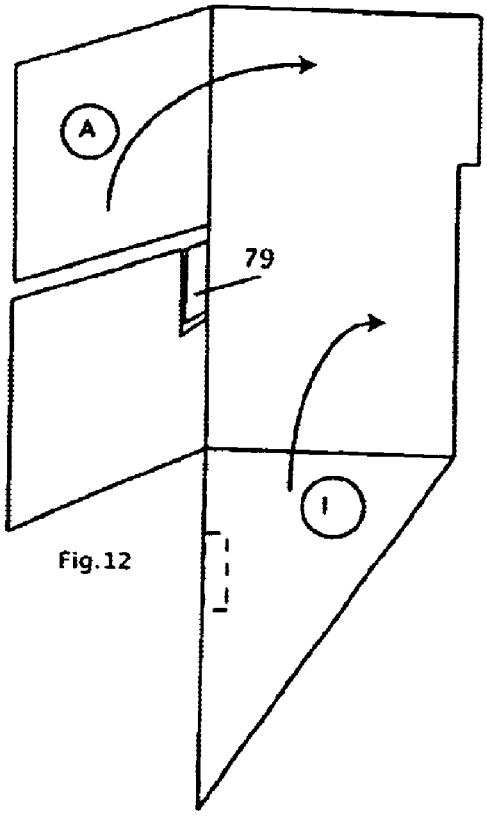
FIG. 12 shows a perspective view of a folder with a split self sealing front cover providing the self sectioning panels.
Figure 12A:
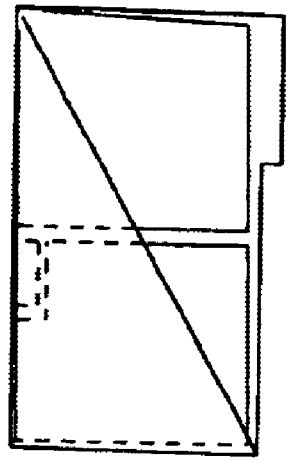
FIG. 12*a* is a front view of a sealed version of FIG. 12.
Figure 13:
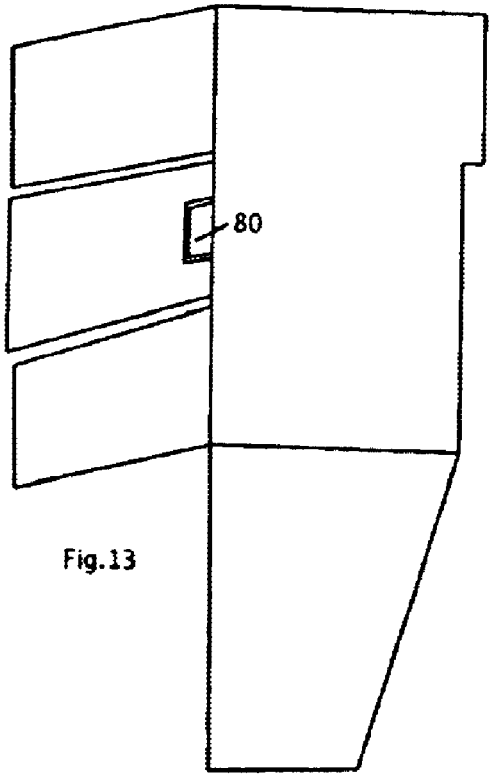
FIG. 13 is a front perspective view of a folder where the self sealing front panel is a three section panel
Figure 13A:
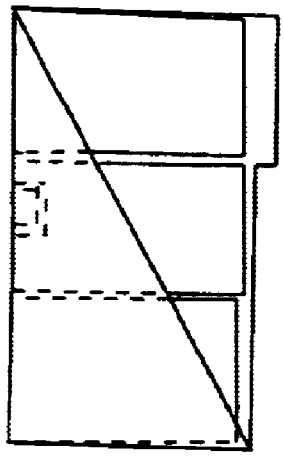
FIG. 13*a* is a front view of FIG. 13
Figure 14:
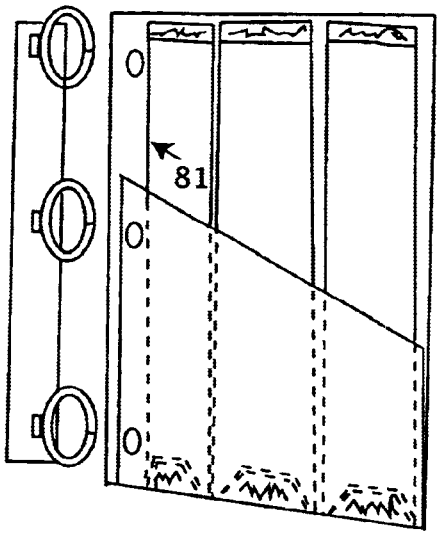
FIG. 14 is a front view of a three panel configuration where closure of the front pocket is provided on three sides, with the third side closed by a set of rings
Figure 15:
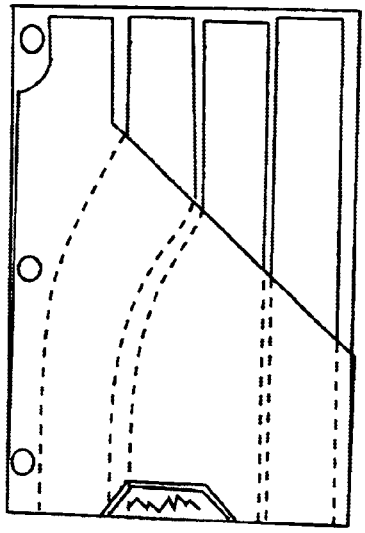
FIG. 15 is a front view of a four panel version as in FIG. 14
Figure 16:
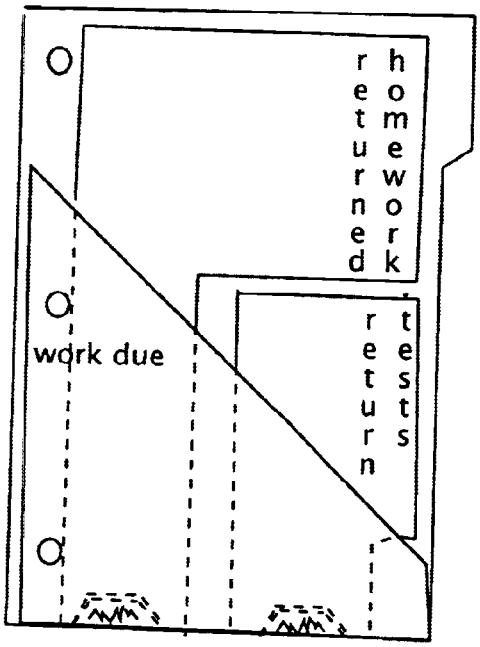
FIG. 16 is a front view of a two panel side tabbed version of FIG. 14.

FIG. 10 is a one panel separator. FIG. 11 shows the seal tab fit into rear and reach through sub classification panel. FIGS. 12, 12*a* shows another variation on a glue tab. FIGS. 13, 13*a* shows only one glue tab in a 3 sub marker panel. FIGS. 14, 15, 16, 17, 18 features additional closure using rings or wire. Here, the sealing tabs are employed. The edge of the left most subclassifier tab may be recessed to avoid linkage to the rings or wire. If the front panel is used as a separator itself, it may be linked to the rings as shown in FIGS. 15 and 17, to the wire. FIG. 15 shows a 4 panel subclassifier w/four "pockets". FIG. 16 shows side tabbing. It features 3 "pockets". An application for FIG. 16 could be school work filing where labels are preprinted as shown or added later. FIGS. 17 and 18 show wire versions of a 3 tab sub classifier. FIG. 19 is the "inverse" of FIG. 18, an ideal format for a cover of a book on an index separator, if made in paper.

It would be possible to print or color print the sub classifier marker tabs.

If each side is tinted a different color, or only (at least) one side is tinted, a nice color complement is displayed on assembly, where subclass marker tabs are contrasted to base cover. This is true of all of the above configurations 1–19.

A good application would be in clear poly, so you could "see through" to your work as it is incrementally separated and sub filed. As shown in FIG. 19, the recessed front cover exposes the tabs. The sealing tabs are bonded through the inside flap, which itself serves as a separator yielding a "3 pocket" format.

The intended sealing along zone 31 can be made in other ways. For example, edge 18 can be sealed along edge 14*a* by heat, a closure tab, or adhesive applied there to and the hinge portion 7/8 left unsealed. In this case, the pocket is still formed and is essentially closed by folding 7/8 one into the other. The rear pocket can have any shape, and can be cut to allow for the exposure of most of the paper stored within without loosing the integrity of the pocket. The pocket panel can be fully glued to the rear cover to form a stiff back without loosing the integral formation of the sectioning panel , as a hinged panel there to, which is the key and significant feature of this invention.

Although it is most practical to form the integral self sectioning file folder from one section of material formed from interconnected panels, it would be possible to combine sections of material to establish the basic four or three panel configurations as shown without loosing the basic novelty of the integral formation of a self-sectioning file according to this invention.

| # | FIG. | What |
|---|---|---|
| 1 | 3 | Front Cover |
| 2 | | Rear Cover |
| 3 | | Pocket Panel |
| 4 | | Self-Sectioning Panel |
| 5 | | Front Cover Expansion Creases |
| 6 | | Self Sectioning Panel Expansion Creases |
| 7 | | Front Cover/Rear Cover Spine Hinge |
| 8 | | Self Sectioning Panel/Pocket Panel Fold Hinge |
| 9 | | Cover Panel/Pocket Panel Fold Hinge |
| 10 | | Primary Glue Zone |
| 11 | | Pocket Panel Pocket Slit(optional) |
| 12 | | 1/3 Cut Tab Marker |
| 13 | | Self-sectioning Tab Markers |
| 14 | | Folder First Side Edge |
| 15 | | Folder Second Side Edge |
| 16 | | Folder First Top Edge |
| 17 | | Folder Second Top Edge |
| 18 | | Pocket Panel First Outer Edge |
| 19 | | Pocket Panel Second Outer Edge |
| 20 | | Pocket Panel Opening Detent |
| 21 | | Self Sectioning Panel First Outer Edge |
| 22 | | Self Sectioning Panel Second Outer Edge |
| 23 | | Self Sectioning Panel Third Outer Edge/Top |
| 24 | | Tear Perforation |
| 25 | | First Self Sectioning Panel Section |
| 26 | | Second Self Sectioning Panel Section |
| 27 | | Third Self Sectioning Panel Section |
| 28 | | Self Sectioning/Pocket Panel First Corner |
| 29 | | Front Cover/Rear Cover Corner Join |
| 30 | | First Fold Over |
| 31 | | Adhesive Applied To Glue Zone |
| 31a | | Adhesive |
| 31b | 2 | Second Fold Over To Form Pocket |
| 32 | | Separated Self Sectioning Panel Deployed |
| P1 | | Paper Height(Substantially h1 Height) |
| 33 | 1 | Integral Self Sectioning File Folder With Rear Pocket |
| h1 | | Front Cover Height |
| h2 | | Self Sectioning Panel Height |
| h3 | | Pocket Panel Height |
| h4 | | Rear Cover Height |
| w1 | | File Folder Width |
| 50 | 4 | Label Area |
| 51 | | Subclassification Marker Tabs |
| 52 | | Tab On File Folder |
| 53 | | Rear Cover Of File Folder |
| 54 | 4a | Landed Perforation For Separation |
| 55 | | Subclassifier Pane; |

-continued

| # | FIG. | What |
|---|---|---|
| 56 | 5 | Stub Front File Cover |
| 57 | 6 | Panel Fold Over |
| 58 | | Landed Separation Perforation |
| 59 | | Side Tabbing |
| 60 | | Hinged Edge |
| 61 | 8 | Extra Sealing Flap |
| 62 | | Landed Area For Separation |
| 63 | 8a | Fold Sealing Flap Over |
| 64 | 9 | Subclassification Marker Tabs |
| 65 | | Open |
| 66 | | Open |
| 67 | | Sealing Tabs In Subclassification Marker Tabs |
| 68 | 9a | Back |
| 69 | | Sealing Tab |
| 70 | | Front |
| 71 | | Marker Tab Panel |
| A | | Fold Over |
| B | | Fold Over |
| 72 | 9b | Marker Tab Panel |
| 73 | | Back |
| 74 | | Front |
| 75 | | Semi-Permanent Landed Perforation |
| E | | Glue |
| C | | Fold Over |
| D | | Fold Over |
| 76 | 11 | Subclassification Panel |
| 77 | | "Reach Through Cutout" In Subclassification Panel |
| 78 | | Glue Tab Punched Through From Rear Cover |
| 79 | 12 | Glue Tab |
| 80 | 13 | Glue Tab |
| 81 | 14 | Edge Recessed To Avoid Linkage To Rings |
| 82 | 16 | Inside Flap |
| 83 | | Exposed Tab Recessed Front Cover |
| 84 | | Sealing Marks |
| 101 | 3a | Front Panel Cover Hinge |
| 100 | | Locking Tab For Forming Box File |
| d1 | | Distance Of Leading Edge Of Locking Tab And Cover Hinge |

What is claimed is:

1. An integral self sectioning file folder with a rear pocket, formed from a single piece of foldable material having an interconnected front cover, rear cover, pocket panel, and self-sectioning panel comprising at least one self-sectioning tab marker, wherein said each of said front cover and said rear cover have a front cover/rear cover spine hinge along a common edge, said rear cover has a front cover/rear cover spine hinge and a cover panel/pocket panel fold hinge along substantially orthogonal coterminous edges and wherein said pocket panel has a cover panel/pocket panel fold hinge and a self-sectioning panel/pocket panel fold hinge along substantially orthogonal coterminous edges, and wherein said self-sectioning panel has a self-sectioning panel/pocket panel fold hinge along a common edge with said pocket panel, and wherein: said front cover is interconnected with said rear cover, and wherein said rear cover is interconnected with said pocket panel and said pocket panel is interconnected with said self-sectioning panel such that said front cover is interconnected to said rear cover along said front cover/rear cover spine hinge, a common edge therebetween, and said pocket panel is hingedly attached to said rear cover along said cover panel/pocket panel fold hinge, a common edge there between, and said self-sectioning panel is hingedly connected to said pocket panel along said self sectioning panel/pocket panel fold hinge, a common edge therebetween, such that when said said pocket panel is folded upon said rear cover along said cover panel/pocket panel fold hinge, each one on top of the other, and in turn, said self-sectioning panel is folded on top of said pocket panel with said self-sectioning panel and said pocket panel substantially coplanar one on top of the other such that said self-sectioning panel/pocket panel fold hinge is interleaved with said front cover/rear cover spine hinge, and further wherein said pocket panel is fixedly attached to said rear cover along a zone located upon said rear cover, said zone being substantially alligned along said front cover/rear cover spine hinge, said front cover panel may be opened and turned out thereby opening said integral self-sectioning file folder, and said self-sectioning panel may be opened and turned out in turn, with said rear panel and said pocket panel forming a pocket therebetween.

2. The integral self-sectioning file folder of claim 1, wherein said self-sectioning panel is comprised of a plurality of self-sectioning tab markers, each separable one from the other and hingedly attached along said self-sectioning panel/pocket panel fold hinge.

3. The integral self-sectioning file folder of claim 1, where in said single piece of foldable material is comprised of a paper board material and said pocket panel is fixedly attached to said rear cover with an adhesive which is applied along said zone located on said rear cover.

4. The integral self-sectioning file folder of claim 1, where in said single piece of foldable material is comprised of poly plastic material and said pocket is fixedly attached to said rear cover with by bonding the poly material of said pocket panel to the poly material of said rear panel along said zone located on said rear panel.

5. A single piece of folded material for forming an integral self sectioning file folder with a rear pocket, said single piece of folded material comprising four interconnected panels said four interconnected panels having an interconnected front cover, rear cover, pocket panel, and self-sectioning panel comprising at least one self-section tab marker, wherein said each of said front cover and said rear cover have a front cover/rear cover spine hinge along a common edge, said rear cover has a front cover/rear cover spine hinge and a cover panel/pocket panel fold hinge along substantially orthogonal coterminous edges and wherein said pocket panel has a cover panel/pocket panel fold hinge and a self-sectioning panel/pocket panel fold hinge along substantially orthogonal coterminous edges, and wherein said self-sectioning panel has a self-sectioning panel/pocket panel fold hinge along a common edge with said pocket panel, and wherein said front cover is interconnected with said rear cover, and wherein said rear cover is interconnected with said pocket panel and said pocket panel is interconnected with said self-sectioning panel such that said front cover is interconnected to said rear cover along said front cover/rear cover spine hinge, a common edge therebetween, and said pocket panel is hingedly attached to said rear cover along said cover panel/pocket panel fold hinge, a common edge there between, and said self-sectioning panel is hingedly connected to said pocket panel along said self sectioning panel/pocket panel fold hinge, a common edge there between, such that when said said pocket panel is folded upon said rear cover along said cover panel/pocket panel fold hinge, each one on top of the other, and in turn, said self-sectioning panel is folded on top of said pocket panel with said self-sectioning panel and said pocket panel substantially coplanar one on top of the other such that said self-sectioning panel/pocket panel fold hinge is interleaved with said front cover/rear cover spine hinge, and when said pocket panel is fixedly attached to said rear cover along a zone located upon said rear cover, said zone being substantially alligned along said front cover/rear cover spine hinge, said front cover panel may be opened and turned out thereby opening said integral self-sectioning file folder, and said self-sectioning panel may be opened and turned out in turn, with said rear panel and said pocket panel forming a pocket therebetween.

* * * * *